US010314387B2

(12) United States Patent
Jungnickel et al.

(10) Patent No.: US 10,314,387 B2
(45) **Date of Patent: *Jun. 11, 2019**

(54) HEAD FOR AN ORAL CARE IMPLEMENT

(71) Applicant: The Gillette Company, Boston, MA (US)

(72) Inventors: Uwe Jungnickel, Weiterstadt (DE); Franziska Schmid, Kronberg/Taunus (DE); Kathi Ballmaier, Frankfurt am Main (DE); Sören Wasow, Frankfurt am Main (DE); Benedikt Heil, Eschborn (DE)

(73) Assignee: THE GILLETTE COMPANY LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/298,426

(22) Filed: Jun. 6, 2014

(65) Prior Publication Data

US 2014/0359958 A1 Dec. 11, 2014

(30) Foreign Application Priority Data

Jun. 6, 2013 (EP) ..... 13170761
May 30, 2014 (WO) ..... US2014/040129

(51) Int. Cl.
*A46B 9/02* (2006.01)
*A46B 9/04* (2006.01)
*A46B 9/06* (2006.01)

(52) U.S. Cl.
CPC ..... *A46B 9/025* (2013.01); *A46B 9/04* (2013.01); *A46B 9/06* (2013.01)

(58) Field of Classification Search
CPC ..... A46B 9/02; A46B 9/025; A46B 9/028; A46B 9/04
See application file for complete search history.

(56) References Cited

U.S. PATENT DOCUMENTS 5,628,082 A * 5/1997 Moskovich ..... A46B 5/02 15/110
2009/0013489 A1* 1/2009 Binet et al. ..... 15/167.1
2010/0115724 A1* 5/2010 Huang ..... A46B 9/025 15/167.1
2010/0223745 A1* 9/2010 Kraemer et al. ..... 15/167.1
2014/0359959 A1* 12/2014 Jungnickel et al. ..... 15/167.1

FOREIGN PATENT DOCUMENTS

JP 2001-218623 A * 8/2001

OTHER PUBLICATIONS

Computer generated English translation JP 2002-218623 A, Kato, Aug. 2001.*

* cited by examiner

*Primary Examiner* — Laura C Guidotti
(74) *Attorney, Agent, or Firm* — Vladimir Vitenberg

(57) ABSTRACT

A head for an oral-care implement comprises at least two tufts extending from a mounting surface of the head. The tufts are inclined with respect to the mounting surface in at least two different directions. Each of the tufts comprises a first group of filaments having a first length and at least a second group of filaments having a second length wherein the first length is different from the second length.

17 Claims, 4 Drawing Sheets

HEAD FOR AN ORAL CARE IMPLEMENT

FIELD OF THE INVENTION

The present disclosure is concerned with a head for an oral care implement and in particular with such a head comprising at least two tufts being inclined with respect to a mounting surface of the head from which they extend.

BACKGROUND OF THE INVENTION

Tufts composed of a plurality of filaments for oral care implements, like manual and powered toothbrushes are well known in the art. Generally, the tufts are attached to a mounting surface of a head intended for insertion into a user's oral cavity. A grip handle is usually attached to the head, which handle is held by the user during brushing. The head is either permanently connected or repeatedly attachable to and detachable from the handle.

Toothbrushes comprising a plurality of tufts wherein at least two tufts are inclined in different directions with respect to the mounting surface from which they extend are also known in the art. For example, a brush head of a toothbrush is known which has a head body and multiple hair assemblies. The head body has a mounting surface and multiple mounting holes defined in the mounting surface. The hair assemblies are mounted respectively in the mounting holes and protrude in an inclined manner from the mounting surface of the head body. The multiple hair assemblies comprise multiple first hair assemblies mounted respectively in circular first mounting holes and multiple second hair assemblies mounted respectively in ellipsoid second mounting holes. Two lines of first hair assemblies are inclined at the same inclined angle relative to the mounting surface of the head body. Second hair assemblies are located at two sides of the lines of the first hair assemblies and are arranged in two parallel lines and are inclined at an inclined angle different from that of the inclined angle of the first hair assemblies.

While toothbrushes comprising these types of hair assemblies clean the outer buccal face of teeth adequately, they are not as well suited to provide adequate removal of plaque and debris from the gingival margin, interproximal areas, lingual surfaces and other hard to reach areas of the mouth.

It is an object of the present disclosure to provide a head for an oral care implement which provides improved cleaning properties, in particular with respect to interproximal and gingival marginal regions of teeth. It is also an object of the present disclosure to provide an oral care implement comprising such head.

SUMMARY OF THE INVENTION

In accordance with one aspect, a head for an oral care implement is provided that comprises at least two tufts extending from a mounting surface of the head, the tufts being inclined with respect to the mounting surface in at least two different directions, wherein each of the tufts comprises a first group of filaments having a first length and at least a second group of filaments having a second length, the first length being different from the second length.

In accordance with one aspect, an oral care implement is provided that comprises such head.

BRIEF DESCRIPTION OF THE DRAWINGS

The invention is described in more detail below with reference to various embodiments and figures, wherein.

DETAILED DESCRIPTION OF THE INVENTION

Figure 1:
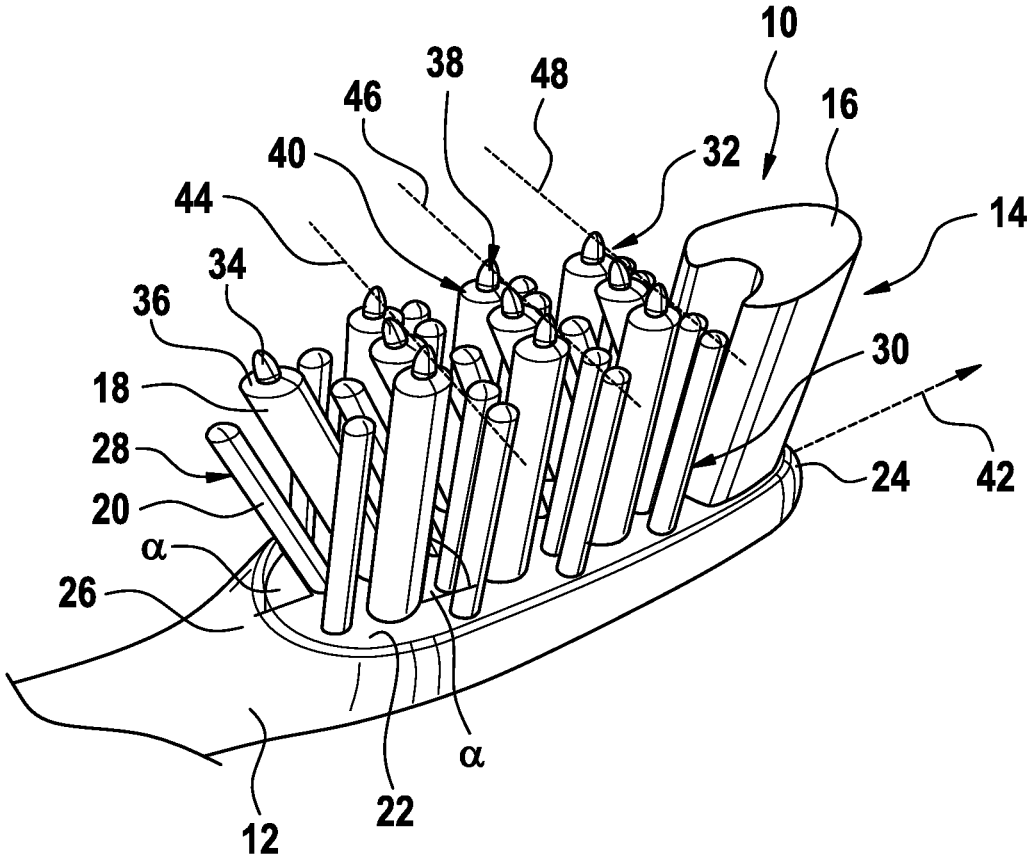
FIG. 1 shows a schematic perspective view of a first embodiment of an oral care implement comprising a first example embodiment of a tuft.

A head for an oral care implement in accordance with the present disclosure comprises at least two tufts which extend from a mounting surface of the head.

The at least two tufts are inclined with respect to the mounting surface defining an inclination angle $\alpha$ between the tuft and the mounting surface. In other words, the at least two tufts are oriented at an inclination angle $\alpha$ relative to that portion of the mounting surface of the head from which they extend. The tufts are angled relative to an imaginary line which is tangent to or co-planar with the mounting surface of the head through which the tuft is secured to the head. The at least two tufts are oriented in different directions. The tufts may be oriented substantially parallel to the longitudinal extension, i.e. along the length of the head and/or orthogonal thereto, i.e. across the width of the head and/or part way between the length and the width of the head. Further, the tufts can also be oriented at different angles $\alpha$.

Each of the at least two tufts comprise a first group of filaments having a first length and at least a second group of filaments having a second length which is different to the first length. The length of a filament is defined by the extension of the filament measured from its lower end being secured at the mounting surface of the head to its upper free end. In other words, the tufts are composed of at least two types of separated/single or isolated filaments which differ in terms of length and which are arranged in respective groups. In the context of this disclosure, a "group of filaments" means at least 10 single filaments having substantially the same length. In some embodiments, the group of filaments having the shorter length comprises at least three times the number of filaments of the other group having the greater length.

Such specific arrangement of tufts may improve cleaning properties of a head for an oral care implement, in particular with respect to interdental areas, as the inclination of the tuft facilitates that the greater/longer filaments may slide into small gaps between the teeth to clean the interdental areas/gaps, while the shorter filaments may clean the occlusal, buccal and lingual surfaces of the teeth. In other words, the inclined alignment of the tufts forces the greater filaments to perform a poke, pivot and slide movement into and in the interproximal areas. The filaments of greater length may assure access to narrow spaces and are able to penetrate deeply into the gaps between teeth and may remove plaque and other residues more effectively. As at least two tufts are inclined in different directions, penetration of the greater filaments into interdental areas may be provided each time when the head is moved into said respective directions. Thus, interdental cleaning is provided more frequently during a brushing process compared to an oral care implement having only one single tuft being inclined in one specific direction.

Each group of filaments and/or the overall tuft may have a circular or non-circular cross-section (the cross-section being perpendicular to length extension of the filaments). For example, the cross-sectional shape can be ellipsoid, squared, rectangular, triangular, cross-shaped, or it can be a prolate ellipsoid with flattened long sides, even though other shapes may be considered as well. The different groups of filaments may have various cross-sections so that various shapes/cross-sections of the overall tuft may be achieved. The cross-section of the tuft may have a width from about 2 mm to about 4 mm and a depth from about 2 mm to about 4 mm.

In some embodiments, the filaments may be made of nylon with or without an abrasive such as kaolin clay, polybutylene terephtalate (PBT) with or without an abrasive such as kaolin clay and/or from nylon indicator material colored at the outer surface. The coloring on the nylon indicator material is slowly worn away as the filament is used over time to indicate the extent to which the filament is worn.

Optionally, the head for the oral care implement may further comprise at least one thermoplastic elastomer element for cleaning and/or massaging the teeth and/or soft tissues of the oral cavity. The thermoplastic elastomer element may be made up of a unitary structure or of a number of substructures. For example, the thermoplastic elastomer element may comprise a large unitary bristle, i.e. a nub, or a number of smaller bristles. The thermoplastic elastomer element may also comprise a fin, cup, like a prophy cup, or a curved or straight wall.

In some embodiments the at least two tufts may be inclined with respect to the mounting surface by an inclination angle $\alpha$ from about 65° to about 80°, optionally from about 70° to about 80°, further optionally from about 74° to about 78°, even further optionally from about 74° to about 75°, about 74° or about 75°. Surprisingly, it was found, that filaments having such inclination angle $\alpha$ may further improve cleaning performance of the head for an oral care implement. Experiments revealed that such filaments are even more likely to penetrate into interdental gaps (cf. examples below).

In some embodiments a difference in length between the first length of the first group of filaments and the second length of the second group of filaments may be from about 1 mm to about 3 mm, optionally from about 1 mm to about 2 mm, further optionally about 1.5 mm. Such difference in length may allow good penetration of the greater filaments into interdental spaces. The length of the shorter filaments measured from the mounting surface to their upper free ends may be from about 8 mm to about 12 mm, optionally from about 10 mm to about 11 mm, further optionally about 10.5 mm. Such difference in length may provide good interdental penetration ability of the longer/greater filaments.

In some embodiments the filaments of the first group have the greater length and the first group abuts at least partially on the second group. The first group of filaments having the greater length may be completely surrounded by the second group of filaments having the shorter length or the first group may only be partially surrounded by the second group of filaments, i.e. neither the first nor the second group of filaments is completely surrounded by the respective other group. The longer filaments are supported by the shorter surrounding filaments which provide the longer filaments with more stability and cleaning capabilities. In case a force is applied to the tuft, the group of shorter filaments acts as a counterforce for the group of greater filaments resulting in a higher bending stiffness of the group of greater filaments. Thus, regular or thin filaments can be used in an interior part of the tuft in order to access and clean narrow interdental spaces with sufficient contact pressure when the head of the oral care implement is moved forward and backward on the occlusal, buccal and lingual surfaces of the teeth.

In case the first group is only partially surrounded by the second group, the first group and the second group each forms at least a portion of the outer lateral area of the tuft, i.e. both groups are exposed to the outer surface of the tuft. In the context of this disclosure the term "outer lateral area" means the outer lateral surface of the tuft excluding the base/bottom and the upper top surface of the tuft. In other words, in case the first group of filaments having the greater length is only partially surrounded by/abuts only partially on the second group of filaments having the shorter length, anisotropic bending stiffness of the group of greater filaments is provided. The different groups of filaments act like a stapled leaf spring by adding up their individual bending stiffness to the resulting overall bending stiffness of the tuft. Due to the anisotropic bending stiffness of the group of filaments having a greater length, better cleaning effects may be provided.

In some embodiments, the tuft may be arranged on the mounting surface of the head in a manner that higher bending stiffness is provided in a brushing direction where the risk of injury to gums is relatively low, like in a direction parallel to the longitudinal extension of the head in order to clean the occlusal, buccal and lingual surfaces of the teeth with higher force in a forth and back movement. Lower bending stiffness may be provided in a direction orthogonal to the longitudinal extension of the head in order to provide a more gentle brushing when the head is moved from the teeth to the gums and vice versa. In other words, the bending stiffness is higher when the head is moved along its longitudinal extension, while the bending stiffness is lower when the head is moved in a sideward direction thereto, for example between the teeth and the gums and vice versa. The lower bending stiffness in the sideward direction may reduce the risk of injury of gums and/or other soft tissues of the oral cavity. The tuft of the head for the oral care implement may ensure high cleaning performance for forth and back movement while the lower bending stiffness in the sideward direction may protect the gums.

Each of the different groups of filaments may have a specific topography/geometry at its free ends, i.e. at their upper top surfaces, which may be shaped to optimally adapt to the teeth contour. For example, at least one group of filaments may have a topography, i.e. an upper top surface which is chamfered or rounded in one or two directions, pointed or formed linear.

In some embodiments, the filaments of the second group may have the shorter length and may define an upper top surface wherein the upper top surface is substantially parallel to the mounting surface. In other words, the upper top surface of the group of filaments having the shorter length may not describe the same inclination angle as the tuft does with respect to the mounting surface of the head. Such upper top surface of the group of shorter filaments may improve cleaning performance of the teeth, in particular of the occlusal, buccal and lingual surfaces, as a larger contact area between the upper surface and the teeth can be provided.

In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

In some embodiments the tuft may further comprise at least a third group of filaments and the first group of filaments may be sandwiched between the second and the third group of filaments. The term "sandwiched" shall mean that the first group of filaments is centrally located and forms at two opposite sides the outer lateral surface of the tuft. Thus, the tuft comprises at least three groups of filaments, wherein at least the first and the second group differ in terms of length. The filaments of the third group may have a length which is equal to the first or second length, or the filaments of the third group may have a third length which is different to the first and second length. The first group of filaments is neither completely enclosed by the second nor by the third group of filaments. This provides a tuft for a head for an oral care implement having a group of filaments with greater length for cleaning interdental areas while the bending stiffness of this group can be adjusted in different directions. For example higher bending stiffness can be provided in a brushing direction along the longitudinal extension of the head, i.e. for brushing the occlusal, buccal and lingual surfaces of the teeth, and a lower bending stiffness in an orthogonal direction thereto, i.e. for brushing in a sideway direction from the teeth to the gums and vice versa.

In some embodiments, the first group of filaments may have the greater length and the second and third group of filaments may have the shorter length. The first group of filaments may form a wiping element which is aligned orthogonal to the longitudinal direction of the head, i.e. across the width of the head. In the context of this disclosure, the term "wiping element" is directed to a section of the first group of filaments which projects above the upper top surfaces of the second and third group of shorter filaments. This projecting section may flap in different directions during the brushing process thereby wiping over the teeth and penetrating into the interdental spaces. In some embodiments, the wiping element has a rectangular or oval cross-sectional shape in order to facilitate penetration of the greater filaments into interdental areas. While the wiping element is designed to reach deeply into the interdental areas, the groups of shorter filaments are designed to clean the occlusal, buccal and lingual surfaces of the teeth when the head of the oral care implement is moved forward and backward, i.e. in a forward and reverse direction. In said forward and reverse direction, the greater/longer filaments abut on the outer filaments of the second and third group, respectively. Thus, the group of filaments having a greater length shows higher bending stiffness when the oral care implement is moved along its longitudinal axis and lower bending stiffness when the oral care implement is moved sideward, i.e. orthogonal to the longitudinal axis.

In some embodiments, the cross-section of the first group of filaments (the cross-section being perpendicular to length extension of the group of filaments) has a width from about 2 mm to about 4 mm, optionally about 3.5 mm and a depth from about 0.6 mm to about 0.8 mm, optionally about 0.7 mm. This relatively small depth may ensure deep penetration of the greater/longer filaments into narrow, hard to reach areas between the teeth while the relatively great width may ensure that the longer filaments clean the teeth in the interdental area over their width.

Alternatively, the first group of filaments being centrally located does not extend completely through the cross-section of the overall tuft. In other words, the outer lateral area of the tuft is composed of one connected section of the first group of filaments, one connected section of the second group of filaments and one section of the third group of filaments. Such an arrangement of filaments may provide increased anisotropic bending stiffness in several directions.

In some embodiments, at least one tuft may be inclined in a direction toward a distal end of the head and at least one tuft may be inclined in a direction toward a proximal end of the head. The term "proximal end of the head" shall mean the end of the head which is proximal to a handle which may be attached to the head, whereas the term "distal end of the head" shall mean the end of the head being opposite to the proximal end of the head, i.e. the free end of the head. In other words, at least one tuft is angled forward and at least one tuft is angled backward with respect to the longitudinal extension of the head. As the inclination of the tuft may facilitate that the greater filaments can slide into interdental areas/spaces in the direction of inclination more easily, the head having at least two tufts which are inclined in opposite directions may improve cleaning properties when the head is moved in said opposite directions (forth and back). In case the head is moved along its longitudinal extension on the teeth surface, the longer filaments of the at least two tufts may be forced to penetrate into the interdental spaces in a forward and backward brushing motion, respectively. Thus, interdental spaces can be cleaned with every single forward and backward brushing stroke.

In some embodiments, the head may comprise at least two rows of tufts, optionally at least three rows of tufts, each row may be arranged substantially along the longitudinal extension of the head and the tufts of each row may be inclined and aligned substantially toward the same direction. The tufts may be inclined in a direction parallel to the longitudinal extension of the head, i.e. along the length of the head, orthogonal thereto, i.e. across the width of the head, and/or part way between the length and the width of the head. Such tuft arrangements may even further improve the cleaning efficiency of the head.

In some embodiments the tufts of at least a first row may be inclined in a direction toward a proximal end of the head and the tufts of at least a second row may be inclined in a direction toward a distal end of the head. Optionally, at least two rows are arranged in an alternating manner, thereby describing a so-called criss-cross tuft pattern in a side perspective view of the head. Such tuft pattern may further improve cleaning properties. When the head of an oral care implement is moved in a forward motion along its longitudinal extension, the group of longer filaments being inclined in the direction toward the distal end of the head may perform a poke, pivot and slide motion thereby penetrating into interproximal areas from a forward direction. When the head is moved in a backward motion, i.e. in the opposite direction of the forward motion, the group of longer filaments being inclined in the direction toward the proximal end of the head may perform the poke, pivot and slide motion thereby penetrating into interproximal areas from the backward direction. Thus, a criss-cross tuft pattern may allow that the groups of longer filaments penetrate into interproximal areas with every single forward and backward brushing stroke along the occlusal, buccal and lingual surfaces of the teeth.

Optionally, a distance/spacing between the tufts within one row may be adapted/correspond to the width of the teeth. This may allow synchronized penetration of the longer filaments into multiple interproximal areas/interdental spaces. Due to the fact that the width of the teeth may vary with the position of the jaws and from one person to the other, a distance/spacing between the tufts within a row may be in the range from about 3 mm to about 6 mm.

In addition or alternatively, the filaments of the group having the greater length may define an upper top surface and the tufts of each row may be arranged in a manner that the respective upper top surfaces of the groups of greater filaments define at least one row which is substantially orthogonal to the longitudinal extension of the head. In other words, the tufts extending from the mounting surface of the head are arranged in at least two rows which are substantially parallel to the longitudinal extension of the head wherein the upper top surfaces of the groups of longer filaments define at least one row/line which is substantially orthogonal to the longitudinal extension of the head. Such arrangement may improve synchronized interdental penetration of the longer filaments. Synchronized interdental penetration may reduce the risk that the longer filaments intermingle or collide during a brushing motion. The user may perceive a more defined interdental cleaning action and may understand said benefit by clear visibility.

In addition or alternatively, the filaments of the greater length may be tapered filaments having a pointed tip. Tapered filaments may achieve optimal penetration in areas between two teeth as well in gingival pockets during brushing and may provide improved cleaning properties. In some embodiments, the tapered filaments may have an overall length extending above the mounting surface of about 10 mm to 16 mm and a tapered portion of about 5 mm to 10 mm measured from the tip of the filament. The pointed tip may be needle shaped, may comprise a split or a feathered end. The tapering portion may be produced by a chemical and/or mechanical tapering process.

In addition or alternatively, the filaments of the first group and the filaments of the second group may further differ from each other at least in one of the following characteristics: diameter, bending stiffness, material, texture, cross sectional shape, color and combinations thereof. The filaments may be crimped, notched, dimpled, flocked or may comprise a series of ribs, for example. Textured filaments tend to enhance cleaning effects on the teeth. The filaments may have a circular or non-circular cross-section, in particular the filaments may have a diamond-shaped cross-section, triangular cross-section or a cross-section that can be described as a prolate ellipsoid with flattened long sides. Further, the filaments may be flagged at their free ends or may also be hollow. The filaments may be made up from nylon with or without an abrasive such as kaolin clay, from polybutylene terephtalate (PBT) with or without an abrasive such as kaolin clay or from nylon indicator material colored at the external surface. The coloring on nylon indicator material is slowly worn away as the filament is used over time to indicate the extent to which the filament is worn. The filaments may have a diameter from about 0.1 mm to about 0.3 mm, optionally from about 0.15 mm to about 0.2 mm. Optionally, the filaments of the third group may also differ from the filaments of the first and/or second group at least in one of the characteristics cited above.

In addition or alternatively, the tuft may be attached to the head by means of a hot tufting process. One method of manufacturing the oral care implement may comprise the following steps: In a first step, tufts are formed by providing a desired amount of filaments. In a second step, the tufts are placed into a mold cavity so that ends of the filaments which are supposed to be attached to the head extend into said cavity. The opposite ends of the filaments not extending into said cavity may be either end-rounded or non-end-rounded. For example, the filaments may be not end-rounded in case the filaments are tapered filaments having a pointed tip. In a third step the head or an oral care implement body comprising the head and the handle is formed around the ends of the filament extending into the mold cavity by an injection molding process, thereby anchoring the tufts in the head. Alternatively, the tufts may be anchored by forming a first part of the head—a so called "sealplate"—around the ends of the filaments extending into the mold cavity by an injection molding process before the remaining part of the oral care implement is formed. Before starting the injection molding process the ends of the tufts extending into the mold cavity may be optionally melted or fusion-bonded to join the filaments together in a fused mass or ball so that the fused masses or balls are located within the cavity. The tufts may be held in the mold cavity by a mold bar having blind holes that correspond to the desired position of the tufts on the finished head of the oral care implement. In other words, the tufts attached to the head by means of a hot tufting process are not doubled over a middle portion along their length and are not mounted in the head by using an anchor/staple. The tufts are mounted on the head by means of an anchorfree tufting process.

The oral care implement may be a toothbrush comprising a handle and a head according to any of the embodiments described above. The head extends from the handle and may be either repeatedly attachable to and detachable from the handle or the head may be non-detachably connected to the handle. The toothbrush may be an electrical or a manual toothbrush.

The following is a non-limiting discussion of example embodiments of a tuft and oral care implements in accordance with the present disclosure, where reference to the Figures is made.

FIGS. 1 to 4 show a first embodiment of an oral care implement 10, which could be a manual or an electrical toothbrush 10 comprising a handle 12 and a head 14 extending from the handle 12 in a longitudinal direction. Three different types of tufts 16, 18, 20 are secured to the head 14 by means of a hot tufting process and extend from a mounting surface 22 of the head 14.

In the toe region at the distal end 24 of the head 14, i.e. furthest away from the handle 12, one crescent-shaped tuft 16 is attached to the head 14. The crescent-shaped tuft 16 is angled by about 80° or less to an imaginary line which is tangent to or co-planar with the mounting surface 22 of the head 14 through which the crescent-shaped tuft 16 is secured to the head 14. The crescent-shaped tuft 16 is tilted/angled away from the handle 12. The crescent-shaped tuft 16 extends past the distal end 24 of the head 14 of the toothbrush 10 and, thus, may clean molars (e.g. wisdom teeth and second molars) in the back of the oral cavity in a more sufficient manner. In some embodiments, the crescent-shaped tuft 16 is made up of filaments formed of PBT with an abrasive such as kaolin clay particles mixes throughout the PBT. In some embodiments, the crescent-shaped tuft 48 has a cross-section which is at least four times as large as any other tuft 18, 20 secured to the head 14.

Along the outer longitudinal edge of the head 14 as well as in the central part thereof are two further types of tufts 18, 20 arranged in rows 28, 30, 32 in an alternating manner.

Tuft 18 (first example embodiment of a tuft in accordance with the disclosure) may have a circular cross-sectional shape and comprise filaments which may consist of PBT with an abrasive, such as kaolin clay particles mixed throughout the PBT. The tuft 18 comprises two groups of filaments 34, 36 wherein the filaments of the first group 34 are longer than the filaments of the second group 36. The first group 34 is surrounded by the second group 36. The first group of longer filaments 34 may have an upper top surface 38 being pointed while the second group of shorter filaments 36 may define an upper top surface 40 which is substantially parallel to the mounting surface 22 of the head 14. There are between six to fourteen tufts 18 secured to the mounting surface 22 of the head 14.

Tufts 20 may have a circular cross-sectional shape and comprise filaments which may consist of a nylon indicator material. In some embodiments, these filaments are blue colored on their external surface. The color is slowly worn away as the toothbrush is used over time to indicate the extent to which the filaments are worn. There are between thirteen to twenty tufts 20 secured to the mounting surface 22 of the head 14.

A first row 28 of tufts 18 alternating with tufts 20 is arranged in the central part of the mounting surface 22. All tufts 18, 20 of the first row are inclined toward the handle 12 relative to an imaginary line which is tangent to or co-planar with the mounting surface 22 of the head 14.

Figure 2:
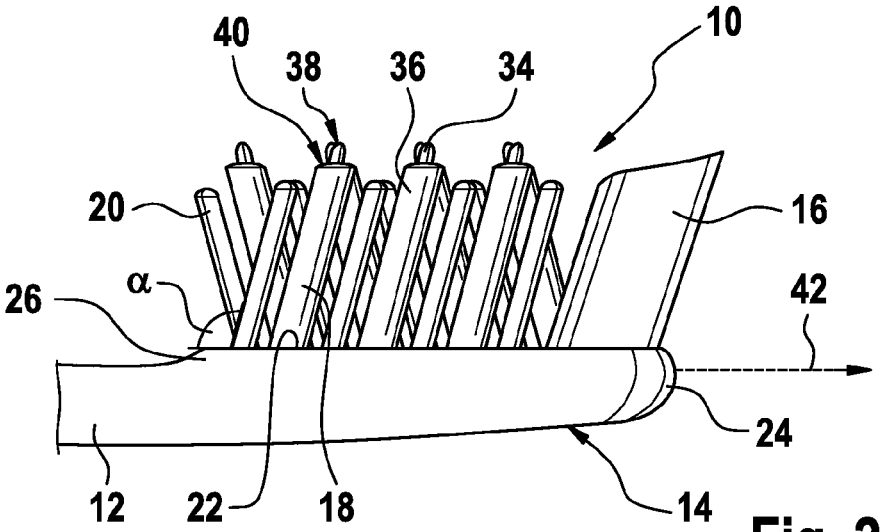
FIG. 2 shows a schematic top-down view of the oral care implement of FIG. 1.
Figure 3:
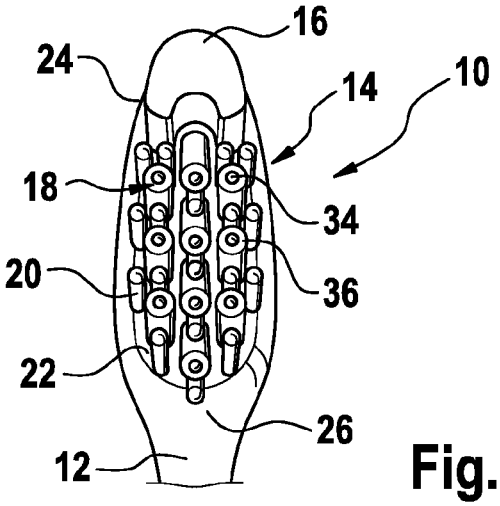
FIG. 3 shows a schematic side view of the oral care implement of FIG. 1.
Figure 4:
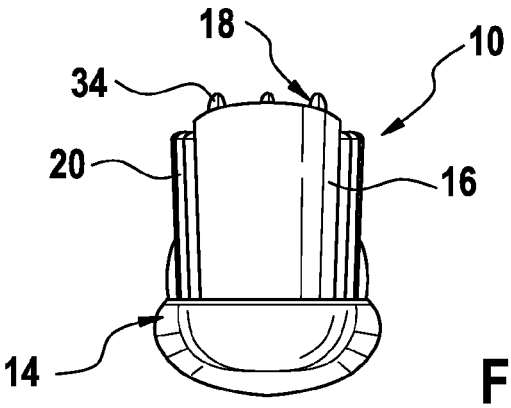
FIG. 4 shows a schematic front view of the oral care implement of FIG. 1.

A second row 30 and a third row 32 of tufts 18 alternating with tufts 20 are arranged on each side of the first row 28, respectively, and are angled in the opposite direction, i.e. away from the handle 12 toward the distal end 24 of the head 14 thereby defining a criss-cross pattern (cf. FIG. 2). Each tuft 18 of the first row 28 alternate with one tuft 20. Each tuft 18 of the second row 30 and third row 32 alternate with two tufts 20, except of the last tuft 18 at the proximal end 26 of the head 14 which alternate only with one tuft 20.

Tufts 18 are arranged in a manner that the upper top surfaces 38 of the first group of greater filaments 34 may define rows/lines 44, 46, 48 which are substantially orthogonal to the longitudinal extension 42 of the head 14 to improve synchronized interdental penetration of the greater filaments.

The tufts 16, 18, 20 attached to the head 14 according to FIGS. 1 to 4 may have an inclination angle $\alpha$ between the respective tuft 16, 18, 20 and the mounting surface 22 of the head 14 of about 65° to about 88°, optionally from about 70° to about 80°, further optionally from about 74° to about 78°, even further optionally about 74°, about 75° or about 76° to provide improved cleaning properties of the toothbrush 10.

Figure 5:
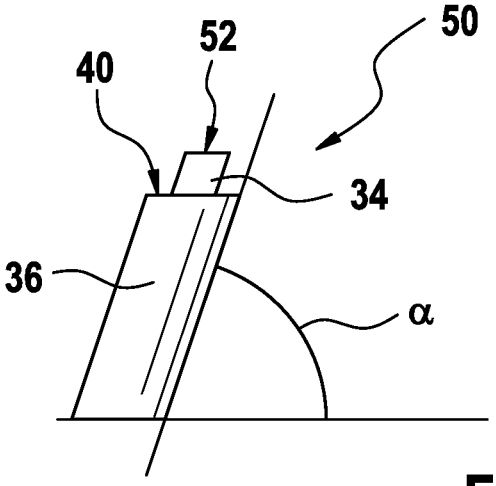
FIG. 5 shows a schematic side view of a second example embodiment of a tuft.
Figure 6:
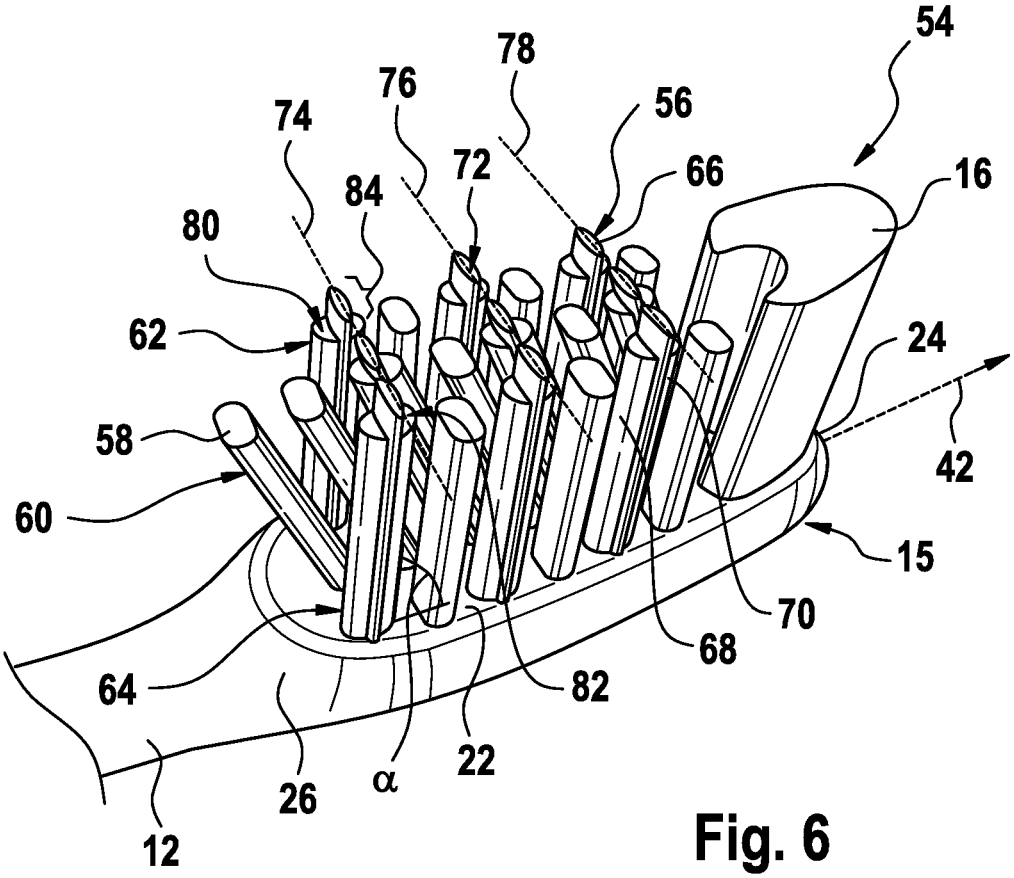
FIG. 6 shows a schematic perspective view of a second embodiment of an oral care implement comprising a third example embodiment of a tuft.
Figure 7:
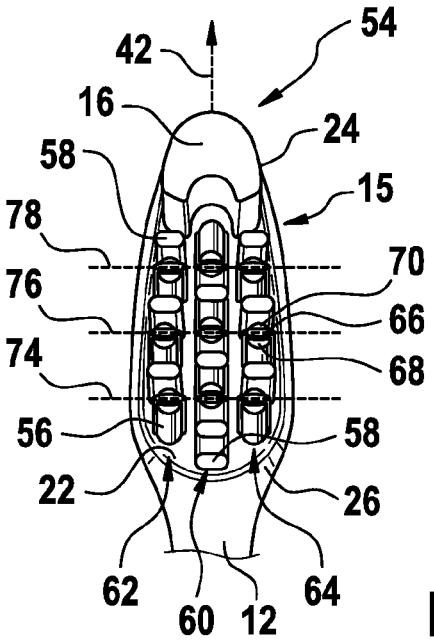
FIG. 7 shows a schematic side view of the oral care implement of FIG. 6.
Figure 8:
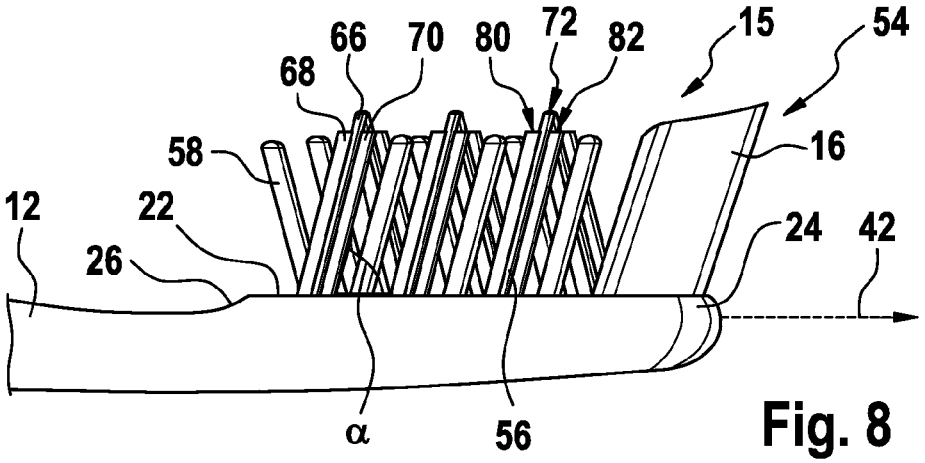
FIG. 8 shows a schematic top-down view of the oral care implement of FIG. 6.
Figure 9:
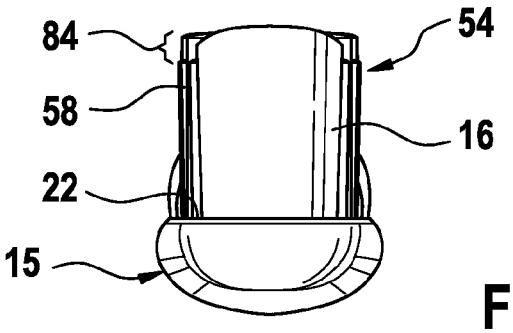
FIG. 9 shows a schematic front view of the oral care implement of FIG. 6.

FIG. 5 shows a second example embodiment of a tuft 50 in accordance with the present disclosure which can be attached on a mounting surface 22 of a head 14 for an oral care implement 10. Tuft 50 is similar to tufts 18 shown in FIGS. 1 to 4. However, the upper top surface 52 of the first group of greater filaments 34 of tuft 50 is substantially parallel to the mounting surface 22 of the head 14.

FIGS. 6 to 9 show a second embodiment of an oral care implement 54, which could be a manual or an electrical toothbrush 54 comprising a handle 12 and a head 15 extending from the handle 12 in a longitudinal direction. Three different types of tufts 16, 56, 58 are secured to the head 15 by means of a hot tufting process and extend from the mounting surface 22 of the head 15.

The first type of tuft 16, namely the crescent-shaped tuft 16 is the same as described with respect to FIGS. 1 to 4. The crescent-shaped tuft 16 is secured in the toe region at the distal end 24 of the head 15, i.e. furthest away from the handle 12.

A first row 60 of tufts 56 (third example embodiment of a tuft in accordance with the present disclosure) alternating with tufts 58 is arranged in the central part of the mounting surface 22. All tufts 56, 58 of the first row 60 are angled toward the handle 12. A second row 62 and a third row 64 of tufts 56 alternating with tufts 58 are arranged on each side of the first row 60, respectively, and are angled in the opposite direction, i.e. away from the handle 12 to the distal end 24 of the head 15, thereby defining a criss-cross pattern (cf. FIGS. 6 and 8). Each tuft 56 of the first row 60 alternate with one tuft 58, except of the last tuft 56 at the proximal end 26 of the head 15 having two tufts 58 adjacent to the handle 12. Each tuft 56 of the second row 62 and third row 64 alternate with one tuft 58.

Tufts 56 comprise three groups of filaments 66, 68, 70, wherein the filaments of the first group 66 are longer/greater than the filaments of the second and third group 68, 70. The first group 66 is sandwiched between the second and third group 68, 70. The section of the longer filaments 66 which projects beyond the upper top surfaces 80, 82 of the second and third groups of shorter filaments 68, 70 forms a wiping element 84 which can flap in a forward and backward direction. When seen in a top down view the wiping element 84 is aligned with its longitudinal extension across the width of the head 15, i.e. orthogonal to the longitudinal extension of the head 15 (cf. FIG. 7). The overall cross sectional shape of tuft 56 is substantially elliptical with flattened sides, wherein each of the second and third group of filaments 68, 70 have a semicircular shape whereas the first group of filaments 66 has a substantially rectangular shape which extends beyond the semicircular shaped second and third groups of filaments 68, 70. The cross-sectional shape of the first group of filaments 66 has a depth which is below the diameter of a standard tuft and a width which is larger compared to a standard tuft. This relatively small depth may ensure deep penetration of the longer filaments into narrow, hard to reach areas between the teeth while the relatively great width may ensure that the longer filaments clean the teeth in the interdental area over their width.

The sandwich-arrangement of filaments described above provides a first group of greater filaments 66 with anisotropic bending stiffness properties revealing the advantages mentioned before. The bending stiffness is higher in the direction where the longer filaments abut on the shorter filaments than in the direction where the longer filaments do not abut on the shorter filaments.

Tufts 56 are secured to the mounting surface 22 in a manner that the longitudinal extension of the first group of filaments 66 extends orthogonal to the longitudinal extension 42 of the head 15. Consequently, the first group of filaments 66 shows higher bending stiffness when the toothbrush 54 is moved along its longitudinal extension, i.e. along the occlusal, buccal and lingual surfaces of the teeth, and lower bending stiffness when the toothbrush 54 is moved orthogonal thereto, i.e. from the teeth to the gums and vice versa. This may ensure higher cleaning performance for forth and back movement while lower bending stiffness in the sideward direction may ensure protection of gums.

Tufts 56 may be arranged in a manner that the upper top surfaces 72 of the first group of greater filaments 66 define rows/lines 74, 76, 78 which are substantially orthogonal to the longitudinal extension 42 of the head 15 to improve synchronized interdental penetration of the greater filaments. The upper top surface 72 of the first group of filaments 66 and the upper top surfaces 80, 82 of the second and third group of filaments 78, 70 are substantially parallel to the mounting surface 22 from which they extend.

Tufts 58 may have a rectangular cross-sectional shape with rounded ends. In some embodiments, tufts 58 comprise filaments which are formed of PBT with an abrasive, such as kaolin clay particles mixes throughout the PBT. There are between five to fifteen tufts 58 secured to the mounting surface 44 of the head 12.

The tufts 16, 56, 58 attached to the head 15 according to FIGS. 6 to 9 may have an inclination angle α between the respective tuft 16, 56, 58 and the mounting surface 22 of the head 15 of about 65° to about 88°, optionally from about 70° to about 80°, further optionally from about 74° to about 78°, even further optionally about 74°, about 75° or about 76° to provide improved cleaning properties of the toothbrush 54.

The toothbrushes 10, 54 according to FIGS. 1 to 4 and 6 to 9 may provide improved removal of plaque and debris from the gingival margin, interproximal areas, lingual surfaces, the outer buccal face and rearward molars.

EXAMPLES

The effects of several variables on the interproximal penetration ability of single filaments were examined including filament inclination angle, diameter of the filament, applied load on the filament simulating tooth brushing pressure and filament velocity.

A single filament tester (SFT) was used comprising an x-y table and a magnetically bound stepper forcer (Normag P/N 4XY0602-2-00 dual axis stepper forcer, manufactured by Nothern Magnetics, Inc., Santa Clarita, Calif.) supported on air bearings. Movement of the forcer about the table was controlled by a 48 VDC dual axis stepping motor controller (Continuum Engineering P/N MCL-200-ST-48, manufactured by Continuum Engineering, Canoga Park, Calif.) equipped with two indexers, an integrated power supply, and a joystick for manual control. The controller was interfaced to a Compaq Deskpro computer for control purposes. The stepper motor was able to achieve precise accelerations and velocities in the x and y directions. Mounted on the top surface of the motor was a set of stainless steel blocks that simulated two interproximal gaps. The entrance to these gaps has a radius of curvature of about 2.5 mm. The simulated stainless steel tooth located between the interproximal gaps had a flat buccal length of about 4.5 mm. A set of custom blocks were machined to hold the test filament at a given angle. The desired block containing a mounted filament was then attached to one end of a precision balance beam. The balance beam had 10 wells with 1 cm separation between the fulcrum and each end of the beam. By placing precision masses in specific wells along the beam, loads could be applied to the test filament in 0.1 g increments. All filaments tested were trimmed to a length of 11 mm. An angle of 90° indicates that the filament was held perpendicular to the flat top surface of the stainless steel blocks. Angles lower than 90° signify a bend away from perpendicular toward the direction of filament travel over the blocks. Penetration observations were made as the teeth travelled while filament remained stationary. Design-Expert software (Design-Expert version 5.0.9, manufactured by Stat-Ease, Inc., Minneapolis, Minn.) was used to construct each experiment and model the resulting data.

Table 1 shows the experimental values used.

TABLE 1

| Variable | Values |
|---|---|
| Inclination Angle α | 90°, 82°, 78°, 74°, 70°, 65° |
| Load | 0.1, 0.2, 0.3 grams |
| Diameter | 0.1524, 0.1778, 0.2032 mm |
| Velocity constant | 101.6 mm/s |
| Material constant | PBT Satintone |
| Tooth type constant | Anterior, with no tooth separation |

Each combination of the variables listed in Table 1 was tested resulting in 54 total runs, without replications. A new filament was loaded for each run conducted, and the behavior of the filament was visually observed as it passed the first gap it encountered.

It was found from both, visual observation and experimental model generated by Design-Expert, that the ability of filaments to penetrate into interdantal gaps is low under all load conditions and filament diameters at angles about 90° because the filaments bend away from the direction of movement or skip over the interdental gaps. In case the filaments are only slightly angled, i.e. having an inclination angle greater than 78°, the filaments still bend away from the direction of movement as the filaments merely move over the teeth.

At an inclination angle of about 78°, the ability of gap penetration is increased for filaments having a relatively high diameter, i.e. about 0.2032 mm when applying a relatively high load of about 0.3 g as well as for filaments having a relatively low diameter, i.e. about 0.1524 mm when applying a relatively low load of about 0.1 g. The relatively high load for filaments having a relatively high diameter provides a downward force necessary to avoid a skipping behavior evident at lower loads. The lower load on filaments having a smaller diameter averts a collapse behavior prevalent at higher loads.

As the inclination angle decreases from about 78° to about 74° the influence of the applied load on the diameter of the filaments decreases. Filaments having an inclination angle from about 74° to about 78° show a further increased ability of interdental penetration. When the inclination angle decreased further from about 74° to about 70° and to about 65° the ability of interdental penetration is still further increased.

Further, it was surprisingly found, that the inclination angle α in combination with filament velocity is a major contributing factor for interdental penetration ability and the amount of time a filament remains in interdental gaps. A longer gap residence time may impact positively the cleaning efficiency of a tuft.

Table 2 shows the tested values to examine the effect of filament velocity and inclination angle α on interdental penetration.

TABLE 2

| Variable | Values |
|---|---|
| Filament Velocity | 12.7, 25.4, 50.8, 101.6, 152.4, 203.2, 254 mm/s |
| Inclination Angle α | 90°, 75° |
| Load constant | 0.2 grams |
| Diameter constant | 0.1524 mm |
| Filament length constant | 11 mm |
| Material constant | Nylon 6.12 |
| Tooth type constant | Anterior, with no tooth separation |

A Sony digital camcorder was used to record videos of each test filament as it passed over the interproximal gap between two tooth forms. The videos were played back in slow motion using a Sony digital VCR. Frame-by-frame examination of the video allowed the quantitative determination of the amount of time the filament remained in the gap. Furthermore, the camera was able to capture a qualitative measure of how far the filament reached into the gap. The filament was judged to be in the gap when its tip was within the space between the curved parts of two adjacent tooth forms. At each velocity/angle combination tested, a new filament was allowed to pass over the tooth forms four times, and an average gap residence time was calculated for the first gap that the filament encountered.

Table 3 shows that filaments having an inclination angle α of about 75° achieve increased gap residence time over a velocity range from about 12.7 mm/s to about 254 mm/s (brushing speed commonly used by individuals) compared to filaments having an inclination angle of about 90°. In particular, the effect of filament velocity is significant between about 12.7 mm/s and about 50.8 mm/s where an exponential decrease in gap residence time is evident as the velocity is increased. At these relatively slow speeds, the filaments have sufficient time to slide into the gap, penetrate all the way to the bottom of the gap between the tooth forms, pivot forward, and then slide out. In case the filament velocity increases above 50.8 mm/s, the filaments have less time to slide into the gap before beginning to pivot. Instead, the filaments start to pivot at the first point of contact on the curved portion of the tooth forms. As the depth of the contact point decreases with increasing velocity, residence time in the gap falls off rapidly. At higher velocities (152.4 mm/s to 254 mm/s), filaments having an inclination angle α of about 75° still show some gap residence times, while filaments having an inclination angle α of about 90° do not penetrate into the gap at all. In the 90° runs the filaments simply skipped over the gap completely. Table 3 shows that the gap residence time decreases at a faster rate for filaments having inclination angle α of about 90° than for filaments having inclination angle α of about 75° as velocity increases. Decreasing the inclination angle of the filaments from 90° to 75° substantially increases gap residence time at all velocities tested. Filaments having an inclination angle α of about 75° showed measurable gap resistance time over the entire range of velocities tested, while at relatively higher velocities filaments having an inclination angle α of about 90° skipped over the gap. Even at lower velocities (less than 50.8 mm/s) where gap residence time was at its highest, filaments having an inclination angle α of about 75° showed a several fold increase in residence time over those having an inclination angle α of about 90°.

TABLE 3

| Filament Velocity (mm/s) | Avg. Time in Gap 90° (s) | Avg. Time in Gap 75° (s) |
|---|---|---|
| 12.7 | 0.23 | 0.78 |
| 25.4 | 0.038 | 0.31 |
| 50.8 | 0 | 0.18 |
| 101.6 | 0.0080 | 0.068 |
| 152.4 | 0 | 0.023 |
| 203.2 | 0 | 0.025 |
| 254 | 0 | 0.030 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A head for an oral-care implement having a proximal end, a distal end opposite to the proximal end, and a longitudinal extension therebetween, the head comprising:

a plurality of tufts extending from a mounting surface of the head, at least some of the tufts being inclined tufts, the inclined tufts comprising tufts that are inclined in a first direction with respect to the mounting surface and tufts that are inclined in a second direction with respect to the mounting surface, the first direction being opposite to the second direction, wherein each of the at least some of the inclined tufts comprises a first group of filaments having a first length, a second group of filaments having a second length different from the first length, and a third group of filaments, wherein the first group of filaments is sandwiched between the second group of filaments and the third group of filaments such that the tuft's outer lateral area comprises a section of the first group of filaments, a section of the second group of filaments, and a section of the third group of filaments, wherein the plurality of tufts forms at least a first longitudinal row of tufts and a second longitudinal row of tufts, each longitudinal row being arranged substantially parallel to the longitudinal extension of the head, wherein the tufts of the first longitudinal row are inclined in a direction toward a proximal end of the head and the tufts of the second longitudinal row are inclined in a direction toward a distal end of the head, the proximal end being opposite to the distal end, wherein the tufts of the at least first and second longitudinal rows comprise the group of filaments having a greater length, which filaments define a first upper top surface that is substantially parallel to the mounting surface, wherein the first upper top surface comprises a first transverse row and a second transverse row, the first and second transverse rows being substantially parallel to the mounting surface and substantially perpendicular to the longitudinal extension of the head, and wherein each of the first transverse row and the second transverse row is formed by at least one of the tufts inclined in the first direction and at least one of the tufts inclined in the second direction.

2. The head according to claim 1, wherein the inclined tufts are inclined with respect to the mounting surface by an inclination angle α from about 65° to about 80°.

3. The head according to claim 1, wherein the inclined tufts are inclined with respect to the mounting surface by an inclination angle α from about 70° to about 80°.

4. The head according to claim 1, wherein the inclined tufts are inclined with respect to the mounting surface by an inclination angle α from about 74° to about 78°.

5. The head according to claim 1, wherein the inclined tufts are inclined with respect to the mounting surface by an inclination angle α from about 74° to about 75°.

6. The head according to claim 1, wherein a difference in length between the first length and the second length is from about 1 mm to about 3 mm.

7. The head according to claim 1, wherein a difference in length between the first length and the second length is from about 1 mm to about 2 mm.

8. The head according to claim 1, wherein a difference in length between the first length and the second length is about 1.5 mm.

9. The head according to claim 1, wherein the first length is greater than the second length and wherein the first group at least partially abuts the second group.

10. The head according to claim 1, wherein the first length is greater than the second length and wherein the second group defines a second upper top surface that is substantially parallel to the mounting surface and is below the first upper top surface.

11. The head according to claim 1, wherein the filaments having a greater length comprise tapered filaments having a pointed tip.

12. The head according to claim 1, wherein the filaments of the first group differ from the filaments of the second group in at least one of the following characteristics: diameter, bending stiffness, material, texture, cross sectional shape, color, and any combination thereof.

13. The head according to claim 1, wherein the tuft is attached to the head by a hot-tufting process.

14. An oral-care implement comprising a head according to claim 1.

15. The head according to claim 1, wherein the head comprises a crescent tuft having a crescent-shaped cross-section and located at the distal end of the head.

16. The head according to claim 15, wherein the crescent-shaped cross-section of the crescent tuft is larger than a cross-section of each of the inclined tufts.

17. The head according to claim 15, wherein the crescent tuft is inclined to extend beyond the distal end of the head.

* * * * *